US008935823B2

(12) United States Patent
Karlsson et al.

(10) Patent No.: US 8,935,823 B2
(45) Date of Patent: Jan. 20, 2015

(54) DEVICE FOR PROCESSING OF CORES

(71) Applicant: Core Link AB, Falkenberg (SE)

(72) Inventors: Jan Karlsson, Falkenberg (SE); Nils Strandh, Gullbrandstorp (SE)

(73) Assignee: Core Link AB, Falkenberg (SE)

( * ) Notice: Subject to any disclaimer, the term of this patent is extended or adjusted under 35 U.S.C. 154(b) by 0 days.

(21) Appl. No.: 14/026,982

(22) Filed: Sep. 13, 2013

(65) Prior Publication Data

US 2014/0013526 A1 Jan. 16, 2014

Related U.S. Application Data

(62) Division of application No. 13/244,441, filed on Sep. 24, 2011.

(30) Foreign Application Priority Data

Oct. 9, 2010 (SE) ..... 1000998

(51) Int. Cl.
*B08B 9/023* (2006.01)
*B65H 73/00* (2006.01)

(52) U.S. Cl.
CPC ..... *B65H 73/00* (2013.01)
USPC ..... 15/88; 15/88.3; 15/104.04; 198/494

(58) Field of Classification Search
USPC ..... 15/88, 88.3, 88.4, 104.04, 3, 4, 230.11; 118/215, 254; 198/494, 624
See application file for complete search history.

(56) References Cited

U.S. PATENT DOCUMENTS

| | | | | | |
|---|---|---|---|---|---|
| 2,722,024 | A | * | 11/1955 | Burke | 12/85.1 |
| 2,814,813 | A | * | 12/1957 | Young | 15/4 |
| 2,888,694 | A | * | 6/1959 | Betzel, Sr. | 15/88 |
| 2,933,746 | A | * | 4/1960 | Frand | 15/4 |
| 3,155,387 | A | * | 11/1964 | Buccicone | 271/196 |
| 3,914,817 | A | * | 10/1975 | Lindsay | 15/3 |
| 4,197,338 | A | * | 4/1980 | Perna | 427/278 |
| 4,441,238 | A | * | 4/1984 | Hijuelos et al. | 29/33 D |
| 5,090,084 | A | * | 2/1992 | De Guzman | 15/230.11 |
| 5,845,871 | A | | 12/1998 | Lynch et al. | |
| 2004/0019986 | A1 | * | 2/2004 | Corrado et al. | 15/3 |
| 2007/0000438 | A1 | | 1/2007 | Milton | |

OTHER PUBLICATIONS

United States Office Action dated Mar. 4, 2014 in U.S. Appl. No. 13/244,441.
United States Office Action dated Jun. 13, 2014 in U.S. Appl. No. 13/244,441.

* cited by examiner

*Primary Examiner* — Randall Chin
(74) *Attorney, Agent, or Firm* — McGinn IP Law Group, PLLC

(57) ABSTRACT

A device for processing cores with a view to restoring same for reuse as good as new and unused cores a number of times for handling and carrying of different types of material webs, includes a number of processing units being arranged to act on the core for removal of material residues and possible other residues in the form of adhesive. The processing surface of the processing units is adapted and/or arranged to adapt itself to the surface of the core on at least the processing thereof under the exercise of a compression pressure between the core and the processing units.

4 Claims, 5 Drawing Sheets

DEVICE FOR PROCESSING OF CORES

The present application is a Divisional Application of U.S. patent application Ser. No. 13/244,441, filed on Sep. 24, 2011, which is based on and claims priority from Sweden patent application No. 1000998-1, filed on Oct. 9, 2010, the entire contents of which is incorporated herein by reference.

The present invention relates to a device for processing a core for reuse.

Various economic reasons make it desirable to be able to recycle cores, preferably more than once. This applies in particular to cores of expensive material, e.g. aluminium, and cores of large dimensions. In order to be able to be recycled and reused, such matter as glue and paper residues must be removed without the core being damaged. The greater part of the residual material on a core can be rinsed off using some form of core cleaner. As a rule, the residual material is pulled off at that glue strand which holds the material web on the core at the beginning of its winding up. The material web on the one side of the glue strand will remain on the core, like the glue strand itself Manual removal of the glue strand and residues of the material web are time consuming and there are major risks of damage to the core, with considerable levels of rejection as a consequence.

The task forming the basis of the present invention is to realize a device which removes the glue strand and material residues from the core without damaging it.

This task is solved according to the present invention in the device disclosed in the present invention.

The present invention realizes a device that automatically processes cores for the removal of material residues and glue residues and restoring the cores into re-usable cores. The cores become as good as comparable with new, unused cores. This implies major savings, not only economic but also environmental, since the requisite transport and new production of cores is reduced.

The present invention will now be described in greater detail hereinbelow with reference to the accompanying Drawings.

Figure 1:
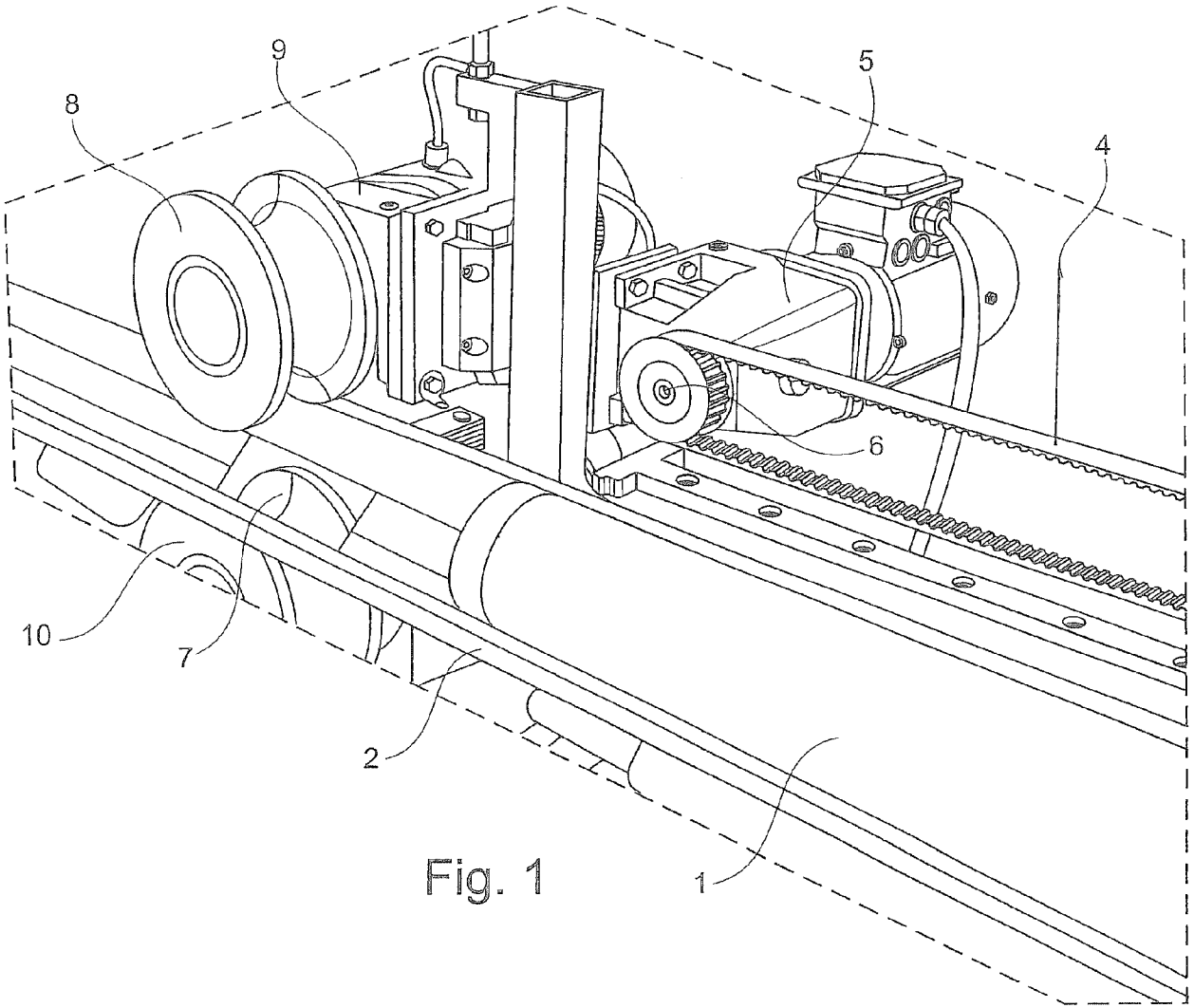
FIG. 1 is a view from the one end of a prototype of one embodiment of a device according to the present invention.
Figure 2:
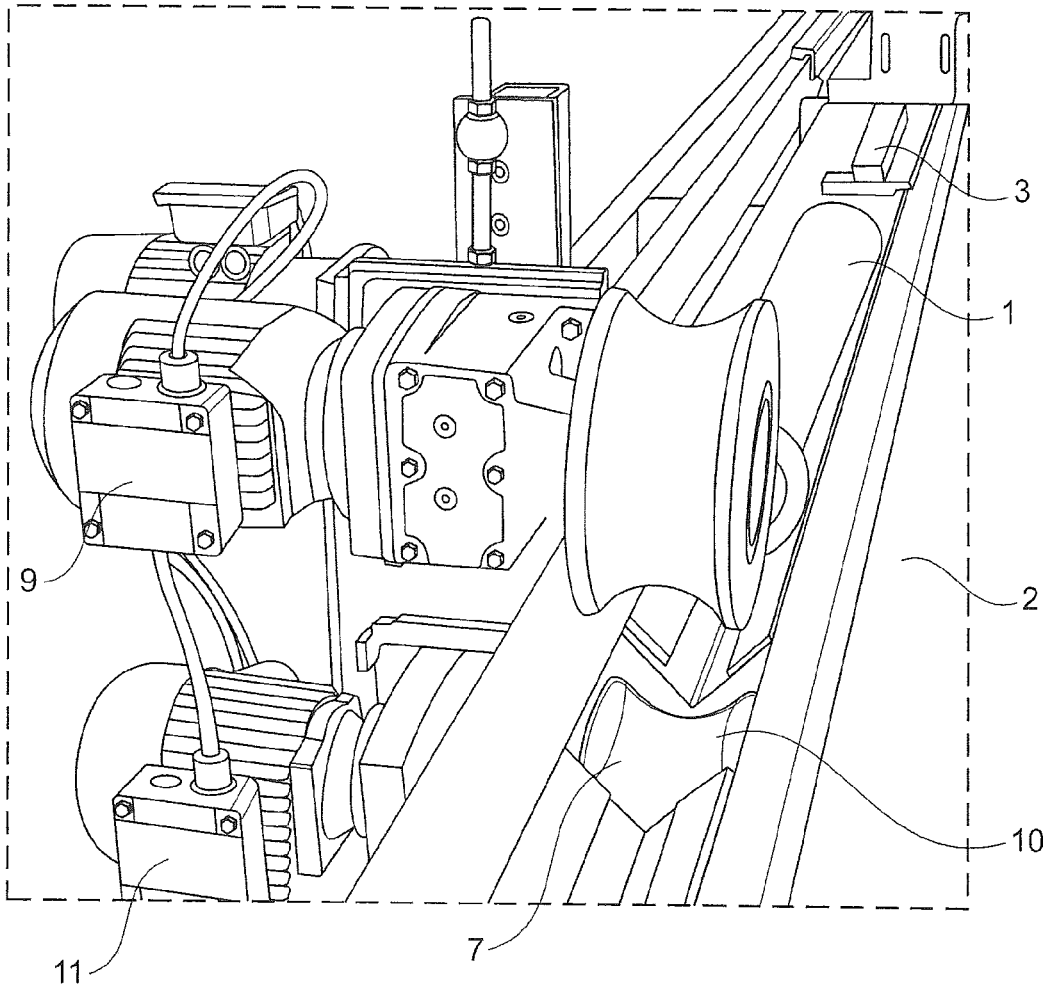
FIG. 2 is a view from the other end of the prototype illustrated in FIG. 1.

The prototype of one embodiment of a device according to the present invention illustrated in FIGS. 1 and 2 is intended for the evaluation of the present invention by cleaning of a core 1, which may be manufactured for example from aluminium. The core 1 rests on a substrate 2 on which the core 1 is axially displaceable by means of a carrier 3. The carrier 3 is in its turn displaceable by means of a cog belt 4 which is driven by means of a cog wheel 6 connected to a motor 5. The carrier 3 is, during displacement, in engagement with the end of the core 1 and shunts the core 1 in front of it on the substrate 2 to a recess 7 in the substrate 2. Above the recess 7, there is disposed a wheel 8 which is mounted on a shaft departing from a motor 9. Beneath the recess 7, there is disposed a wheel 10 which is mounted on a shaft departing from a motor 11.

The wheels 8 and 10 are manufactured from a rubber-like material, e.g. polyurethane, either completely or only on that surface which is turned to face the core 1 and is to process the core 1. The wheels 8 and 10 have an inwardly arched surface displaying substantially the same radius as the core 1 or a slightly smaller radius than the core 1 and are thus shaped in response to the core 1 which is to be processed. The abutment between the core 1 and the wheels 8 and 10 will be good throughout the entire surface, which corresponds to up to 100 degrees of the circumference of the core.

The carrier 3 shunts the core 1 in between the wheels 8 and 10, which are advantageously rotated in a direction towards the direction of movement of the core 1 so that material residues and glue residues are ejected rearwardly from the wheels 8 and 10 and the core 1. Possibly, brushes and/or blowing and/or suction nozzles may be provided for removing material and glue residues. The processing of the core 1 may be likened to a rubbing operation and the core 1 may be displaced past the wheels 8 and 10 several times and possibly be pivoted or rotated somewhat between these displacements. There may thus be provided a carrier on the receiving side seen in FIGS. 1 and 2 for returning the core 1 to the starting position. After every passage of the wheels 8 and 10, it may be appropriate to pivot or rotate the core 1 a number of degrees or parts of a turn.

Figure 3:
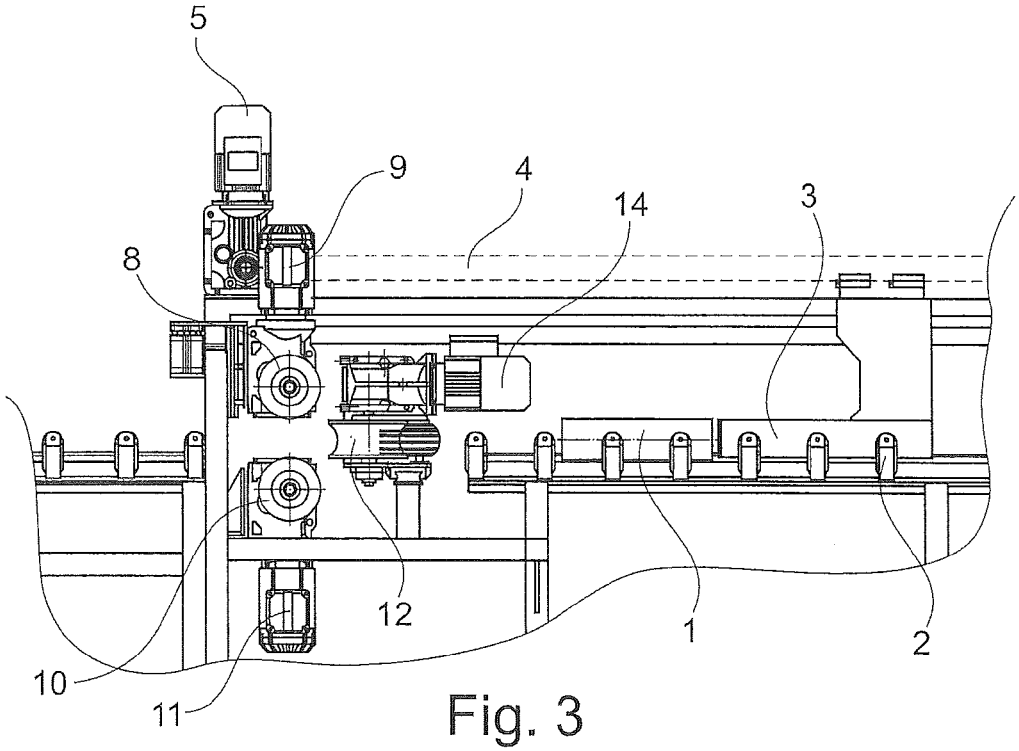
FIG. 3 is a side elevation of a device according to the present invention.
Figure 4:
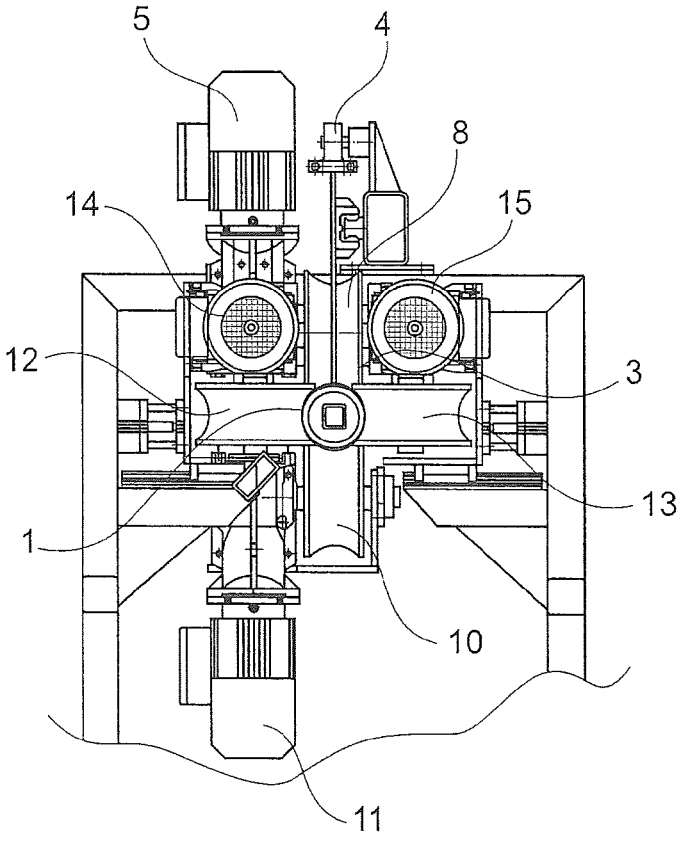
FIG. 4 is an end elevation of the device according to the present invention illustrated in FIG. 3.

The embodiment of a device according to the present invention illustrated in FIGS. 3 and 4 displays a substrate 2 in the form of rollers on which the core 1 rests and is moveable by means of a carrier 3. The carrier 3 is displaceable by means of a cog belt 4 which is driven by means of a motor 5 and displaces the core 1 towards the wheels 8 and 10 as well as the wheels 12 and 13. The wheel 8 is disposed on the upper side of the core 1, while the wheel 10 is disposed on the underside of the core 1, substantially straight beneath the wheel 8. The wheel 12 is disposed on the one side of the core 1, while the wheel 13 is disposed on the other side of the core 1, substantially opposite the wheel 12. The wheels 12 and 13 are positioned ahead of the wheels 8 and 10 seen in the direction of displacement of the core 1. The wheels 8, 10, 12 and 13 are each driven by its motor 9, 11, 14 and 15 via a bevel gear. The wheels 8, 10, 12, 13 have substantially the same design as the wheels 8 and 10 described in connection with the embodiment according to FIGS. 1 and 2.

It will clearly be apparent from FIG. 4 that the wheels 8, 10, 12, 13 cover the entire circumference of the core 1, for which reason it should be sufficient with one single passage thereof for complete cleaning from glue strand residues and material residues.

The degree of circumference may be varied, but in the event of lesser circumference, the position of the glue strand must be established, which is possible if the paper tail is slight or wholly absent. Most types of cores can be processed after adaptation of the pressure with which the wheels are applied against the core, the hardness of the polyurethane, which must be softer the more fragile the core is, as well as the relative speed between the core and the wheels. The processing of certain types of cores is commenced inside the one end of the core and continues up to and past the other end in order to avoid damage to the ends.

The described embodiment of a device according to the present invention may be modified in such a manner that the rotary wheels are displaced along a stationary core, that the rotating wheels are displaced along a rotating core, which is either axially stationary or is displaced axially, and that the rotary wheels are displaced. There may also be provided several sets of wheels along the core.

Figure 5:
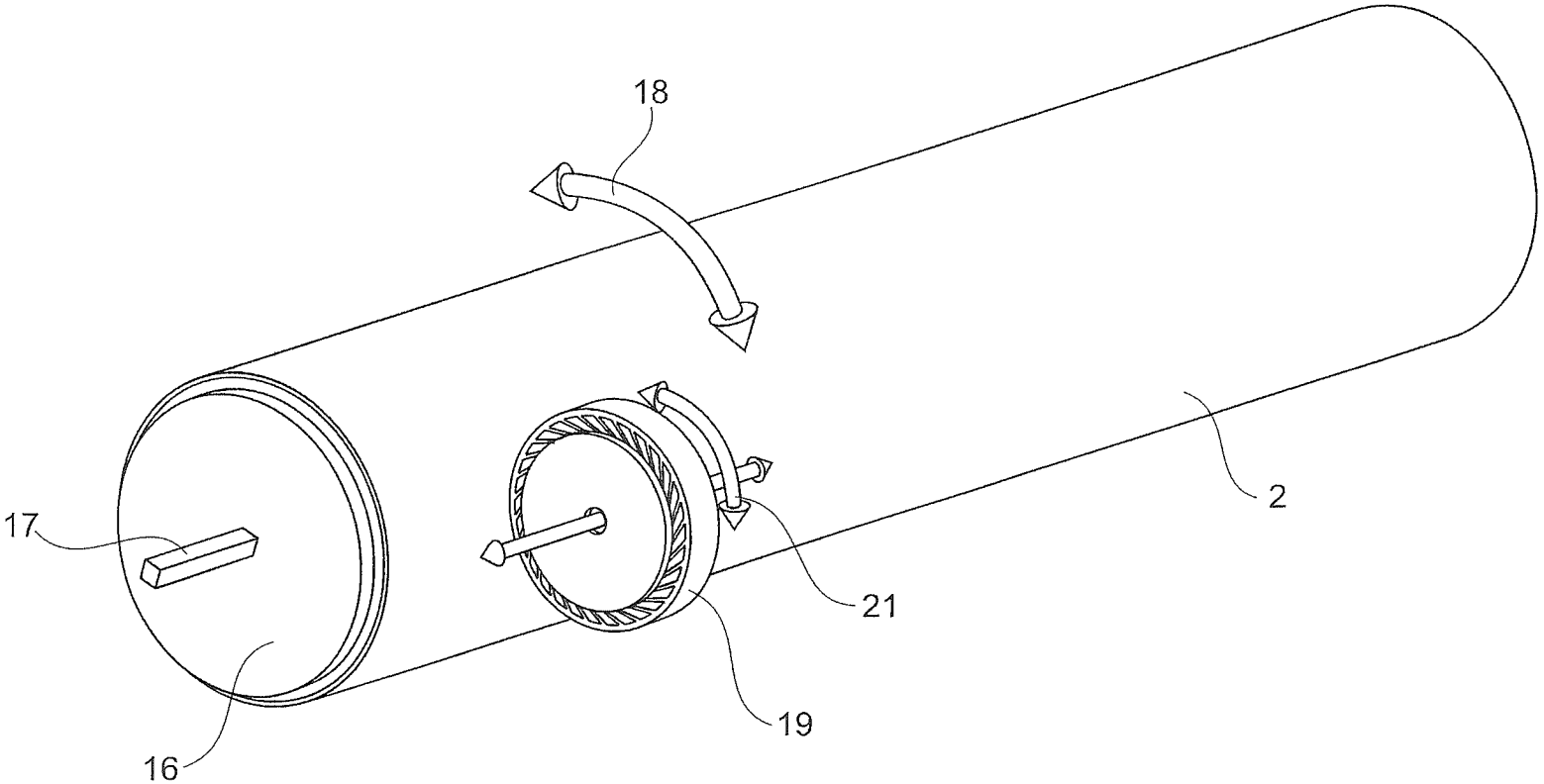
FIG. 5 is a perspective view of a core with a further part of a device according to one embodiment of the present invention.
Figure 7:
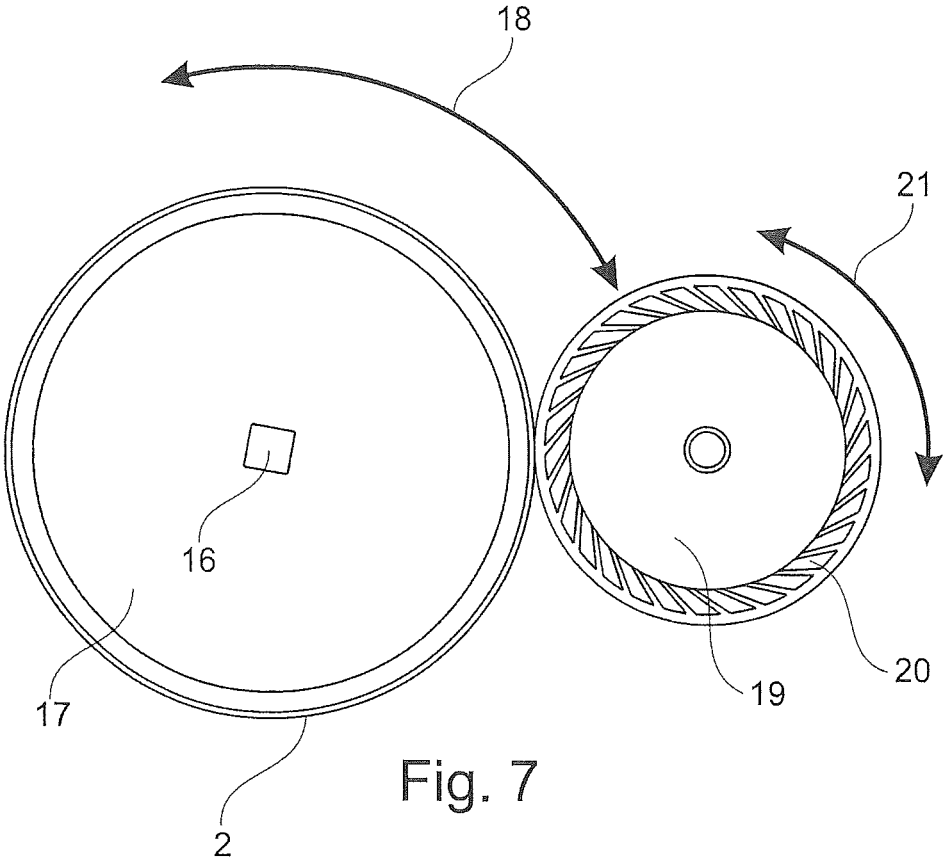
FIG. 7 shows, on a larger scale, an end elevation of the parts illustrated in FIGS. 5 and 6.
Figure 6:
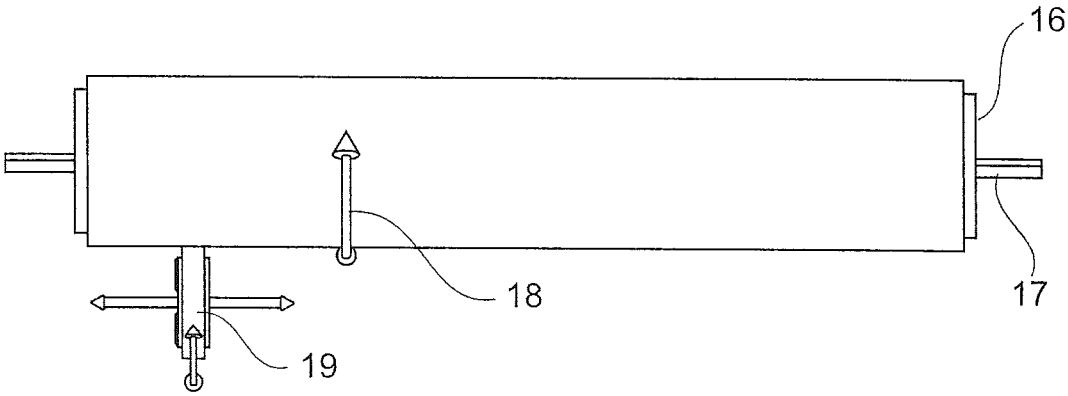
FIG. 6 is a top plan view of the parts illustrated in FIG. 5.

FIGS. 5-7 illustrate yet a further embodiment of a device according to the present invention for cleaning of a core 2 from material residues, for example glue and paper residues, e.g. tissue residues. The core 2 is placed between chucks 16 which are provided with stub shafts 17 for rotation thereof in the direction of the arrow 18. A wheel 19 which has a friction or casing surface of rubber or a rubber-like material, e.g. polyurethane, is urged against a core 2. Inside the casing surface, there are disposed a number of open cells or through-going cavities 20 which impart to the casing surface a certain resilience and facilitate the configurational adaptation of the casing surface to the shape of the core 2. The wheel 19 is rotated in the direction of the arrow 21. The arrows 18 and 21 are double-headed and the rotation of the core 2 and the wheel 19 must take place towards one another. If the core 2 is rotated clockwise, the wheel 19 must be rotated counter clockwise, and vice versa. The wheel 19 is reciprocally displaceable along the core 2 and during rotation thereof in order, by scraping or rubbing, to remove primarily material residues for achieving as thorough a cleaning of the circumferential surface of the core 2 as possible without any damage thereto. The circumferential surface is detected and the procedure is repeated until the desired level of cleanliness has been achieved.

In particular in the handling of large cores, e.g. tissue cores of an inner diameter of 300-600 mm, it may be rational to provide two or even more wheels 19 along and/or about the core 2 for processing its circumferential surface.

Other modifications of the device according to the present invention are also conceivable without departing from the scope of the inventive concept as defined in the appended Claims.

What is claimed is:

1. A device for processing a core for reuse to handle and carry different types of webs, the device comprising:

at least one processing means being arranged to act on the core for removal of material residues including an adhesive, wherein a processing surface of the at least one processing means comprises a concave surface that fits onto a convex surface of the core as the core moves laterally with regard to the at least one processing means under a compression pressure between the core and the at least one processing means, wherein said at least one processing means comprises at least one wheel with a flexible circumferential casing surface that rotates parallel with the core during rotation thereof, said at least one wheel being displaced axially along the core, and wherein inside the circumferential casing surface, said at least one wheel includes a number of open cells, which impart resilience and facilitate configurational adaptation of the casing circumferential surface of said at least one wheel to the configuration of a circumferential surface of the core wherein the concave surface of said at least one processing means comprises a rubber-like material.

2. The device as claimed in claim 1, wherein said at least one wheel includes a frictional surface.

3. The device as claimed in claim 1, wherein the rubber-like material of said at least one processing means contacts the convex surface of the core.

4. The device as claimed in claim 1, wherein, as the core moves laterally with regard to said at least one processing means, the rubber-like material of said at least one processing means abuts the convex surface of the core.

* * * * *